US005557996A

United States Patent [19]

Reber et al.

[11] Patent Number: 5,557,996

[45] Date of Patent: Sep. 24, 1996

[54] METHOD AND APPARATUS FOR CUTTING PIECES OF CLOTH FOR USE IN QUILTS OR THE LIKE

[76] Inventors: James K. Reber; Jill A. Reber, both of 10481 NW. 107th Ave., Granger, Iowa 50109

[21] Appl. No.: 208,490

[22] Filed: Mar. 9, 1994

Related U.S. Application Data

[63] Continuation of Ser. No. 57,509, May 6, 1993, abandoned.

[51] Int. Cl.[6] ..... B26D 3/00

[52] U.S. Cl. ..... 83/56; 30/292; 33/562; 33/563

[58] Field of Search ..... 83/13, 56, 743, 83/745, 614, 821; 30/114, 286, 289, 292; 269/87.2; 33/11–16, 562, 563, 565, 32.1, 32.2, 32.3; D10/64; D19/37, 39

[56] References Cited

U.S. PATENT DOCUMENTS

| | | | |
|---|---|---|---|
| 147,942 | 2/1874 | Hutchinson | D10/64 |
| 1,544,327 | 6/1925 | Loewenthal | 33/562 X |
| 2,797,493 | 7/1957 | Watson | 33/565 |
| 2,823,461 | 2/1958 | Schneider | D10/64 |
| 2,903,795 | 9/1959 | Wilfert . | |
| 3,104,467 | 9/1963 | Lloyd-Young | 33/562 X |
| 3,576,148 | 4/1971 | Katz | 83/455 |
| 4,053,986 | 10/1977 | Axelrod | 33/12 X |
| 4,565,006 | 1/1986 | Vouyouka | 33/12 X |
| 4,651,434 | 3/1987 | Haynes | 33/562 X |
| 4,779,346 | 10/1988 | Schafer . | |
| 5,191,716 | 3/1993 | Anderson | 33/483 |

FOREIGN PATENT DOCUMENTS

| | | | |
|---|---|---|---|
| 0070316 | 12/1949 | Denmark | 33/562 |

OTHER PUBLICATIONS

Brochure, including front and back page, and p. 14 showing an All Angle Cutting Template—The Keepsake Quilter dated Winter 1992, vol. 5.

Brochure, including front and back page, pp. 55, 56, 57 and 58, entitled Special Edition Clotilde, dated Jan. 1993.

Brochure, including front and back page, pp. 118, 119, 120 and 121, entitled Nancy's Notions Catalog No. 19, dated Feb. 20, 1993.

Brochure, 8 pages from Shar's Prairie Patchwork of Montevideo, MN.

*Primary Examiner*—Eugenia Jones

*Attorney, Agent, or Firm*—Henderson & Sturm

[57] ABSTRACT

A method and apparatus for cutting cloth into shapes for use in quilts or the like. A sheet of transparent material has a first linear slot disposed through a sheet at a first location on the sheet so that a cutter can extend therethrough to cut several layers of cloth. A second linear slot is disposed through the sheet at a second position so that the cutter can be used to cut through cloth located below the second slot. The second slot is oriented at an angle of less than 90° with respect to the first linear slot so that various shapes can be made using the combination of straight and angled cuts.

21 Claims, 3 Drawing Sheets

METHOD AND APPARATUS FOR CUTTING PIECES OF CLOTH FOR USE IN QUILTS OR THE LIKE

This is a continuation of application Ser. No. 08/057,509 filed on May 6, 1993 now abandoned.

TECHNICAL FIELD

The present invention relates to an apparatus for use in cutting cloth for quilt making or the like and more particularly to a sheet of transparent plastic material with slots therein for use as a cutter guide for cutting pieces of cloth used for making quilts or the like.

BACKGROUND ART

Part of the process for making quilts is a tedious task of cutting out many duplicate sizes of cloth which are later to be sewn together to form an outer surface of a quilt. One of the traditional shapes used in quilts is a triangle made by a method of measuring each side of a square and cutting out the square, followed by the process of diagonally cutting the square of cloth from one top corner to the opposite bottom corner, thereby forming a triangular piece of cloth on each side of the diagonal cut. This is quite often done to several layers of cloth in order to form multiple triangles at one time. But it is still a time consuming process, especially if it must be done over and over in order to produce a large quantity of triangular shaped cloth pieces, as is often the case for quilt makers. It would be desirable to be able to reduce the number of steps for this process if possible.

Most rulers produced for the quilting industry are triangle shaped plexiglass devices with opaque marking thereon, for example as shown in U.S. Pat. No. 4,779,346 to Schafer. Many of these rulers are merely measuring devices so that once the points forming the exterior of the shape are produced using these measuring rulers, the shape is then cut in the traditional way.

There are other rulers which have one end which is essentially rectangular in shape and the other end which has something other than a 90° or a 180° edge thereon so that angular cuts can be made along the edge thereof. There are also triangles produced for this purpose made out of clear plexiglas material. A problem with cutting along the edge is that the cutter can move away from the edge and thereby make an undesirable detour, thereby ruining a portion of the cloth being cut. This can also be a safety hazard if the user's hand or finger is in the way.

There are also quilting templates which are merely made in the shape of the pieces of cloth to be cut. Consequently, the user merely moves the cutter around the outside of the template to form the shape desired. These shapes are quite often very small and consequently there is a problem holding the templates with one hand while cutting around it with the cutter with the other hand because the cutter can easily come in contact with the hand holding the template. Furthermore, this is a very awkward procedure which results in many ruined pieces of cloth due to the fact that the template is often inadvertently moved as the user repositions the user's hands to cut from one side of the template to the other.

Consequently there is a need for a ruler for use in quilt making which simplifies the steps of making and cutting pieces of cloth. Furthermore, there is a need for such a device which is safer than the devices of the prior art.

DISCLOSURE OF THE INVENTION

The present invention relates generally to a method and apparatus for cutting cloth into shapes for use in quilts or the like. A sheet of transparent material has a first linear slot disposed through a sheet at a first location on the sheet so that a cutter can extend therethrough to cut several layers of cloth. A second linear slot is disposed through the sheet at a second location so that the cutter can be used to cut cloth located below the second slot. The second slot is oriented at an angle of less than 90° with respect to the first linear slot so that various shapes can be made using the combination of straight and angled cuts.

An object of the present invention is to provide an improved apparatus for cutting pieces of cloth for use in the construction of quilts.

Another object of the invention is to provide a method and apparatus for speeding up the process of cutting pieces of cloth for use in the construction of quilts.

A still further object of the invention is to provide a static sticker for use in combination with a cutting guide to provide a reference for forming shapes of cloth the same size as the static sticker.

Another object of the invention is to provide a ruler having a cutting guide therein for safety purposes.

A still further object of the invention is to provide a ruler for quilt-making which can be used right or left-handed without modifications.

Another object of the invention is to provide a quilt-maker's ruler wherein there is no need to flip the ruler as is necessary for some prior art rulers.

Other objects, advantages, and novel features of the present invention will become apparent from the following detailed description of the invention when considered in conjunction with the accompanying drawings.

BRIEF DESCRIPTION OF THE DRAWINGS

FIG. 2–5 show a sequence of how to cut triangular pieces of cloth from a stack of sheets of cloth;

BEST MODE FOR CARRYING OUT THE INVENTION

Figure 1:
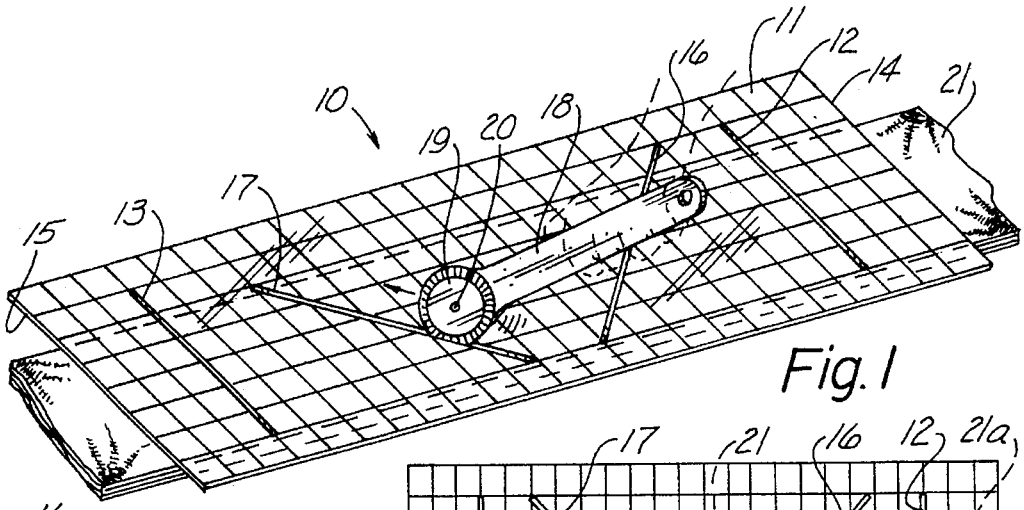
FIG. 1 is a perspective view of a quilt cutting guide constructed in accordance with the present invention having slots therein for guiding a cutter to cut layers of cloth disposed beneath the cutter guide.

Referring now to the drawing wherein like reference numerals designate identical or corresponding parts throughout the several views, FIG. 1 shows a cutting guide (10) constructed in accordance with the present invention. The cutting guide (10) is constructed of a polycarbonate product which can be purchased under the trademark name of LEXAN® or from other unbreakable clear plastic material. While rulers are often made of PLEXIGLAS® it has been determined that this polycarbonate product is far superior to PLEXIGLAS® because it will not break easily. This is especially important and critical for a cutting guide of the type shown because the slots will weaken the sheet (11) and if it is made of PLEXIGLAS® or the like, it will break during normal usage.

The sheet of material (11) has an opaque grid printed on the underside thereof which can be viewed from the top side thereof since the sheet (11) is transparent. Each grid can be numbered if desired, in inches for example, to provide the measurements necessary. Slots (12) and (13) are parallel to the ends (14) and (15) and are also parallel to each other. A slot (16) is formed at a 45° angle with respect to the slot (12) and a slot (17) is formed at a 45° angle with respect to the slot (13). All of the slots (12, 13, 16, and 17) extend completely through the sheet (11) so that a cutter (18) having a circular cutter blade (19) rotatably attached thereto at pin (20) can be used to cut cloth in a stack (21) below the cutting guide (11) and through the respective slot, for example through slot (17) shown in FIG. 1.

Figure 3:
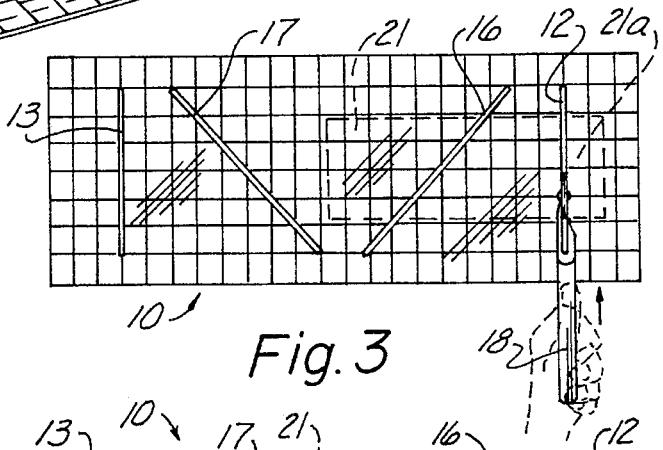
FIG. 3 shows the next step in the process of cutting the strips of cloth.
Figure 4:
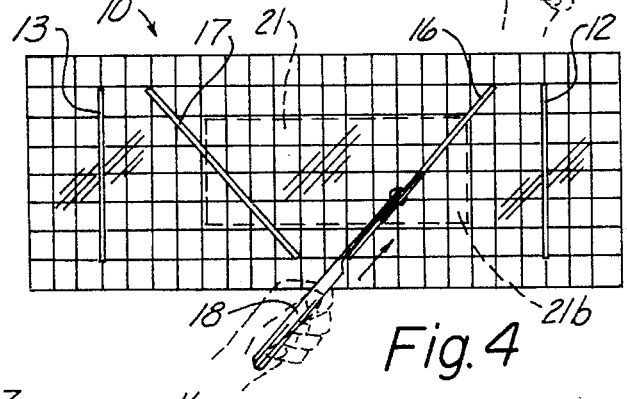
FIG. 4 shows still another step in the process of cutting triangular pieces of cloth from the stack of larger cloth pieces.

In use, several layers of cloth (22) can be placed on a working surface, and the guide (10) can be place over it. Using the grid, the layers (22) can be measured so that the width of a strip (21) can be cut from the stack of layers of material (22). After this is done, the cloth (21), having several layers, would be placed on a working surface so that the guide (10) can be placed thereover in such a way that one end can be cut by making the cut shown in FIG. 3. That is done in order to start with a clean cut on the right edge of the material (21), discarding the portion (21*a*) of the material. Then the guide (10) would be moved to the right in the position shown in FIG. 4 so that the slot (16) is at the top right corner of the cloth (21) as shown in FIG. 4. Then the cutter (18) can be used to cut a triangular strip (21*b*) which is the shape of the cloth to be used for the quilt.

Figure 5:
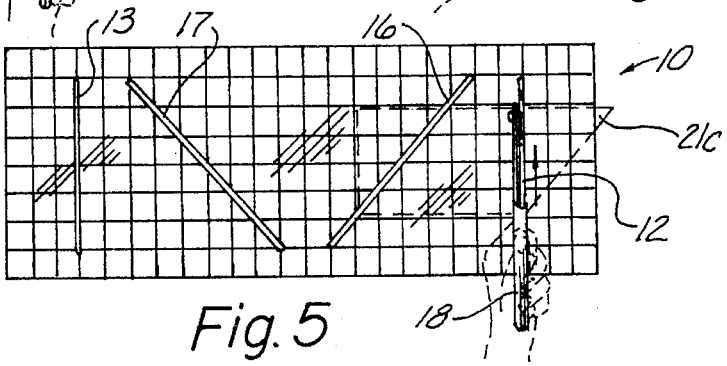
Figure 6:
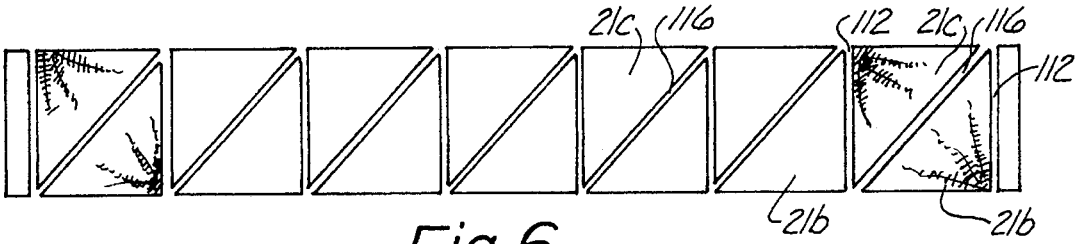
FIG. 6–10 show various cuts through stacks of cloth for making the shapes shown in these figures by merely moving the slots in the cutting guide to the places where these cuts need to be made.

After the removal of the stack (21*b*), the guide (10) is moved to the position shown in FIG. 5 so that the slot (12) is at the juncture of the lower horizontal portion of the cloth and the diagonal portion, so that when a cut is made along guide (12) as shown in FIG. 5, a stack of cloth portions (21*c*) are formed which are of an identical shape to the shape of the cloth pieces (21*b*). This process is simply repeated over and over until all of the strip (21) has been cut into pieces of the shape (21*b*) and (21*c*). This sequence is shown in FIG. 6 showing all of the cut from right to left with the vertical cuts (112) being made by the cutter passing through slot (12) and the diagonal cuts (116) being made by the cutter passing through slot (16). In each step the ruler or guide (10) is merely moved to the position needed after the last cut in order to make the pieces (21*b*) and (21*c*) as shown.

Figure 2:
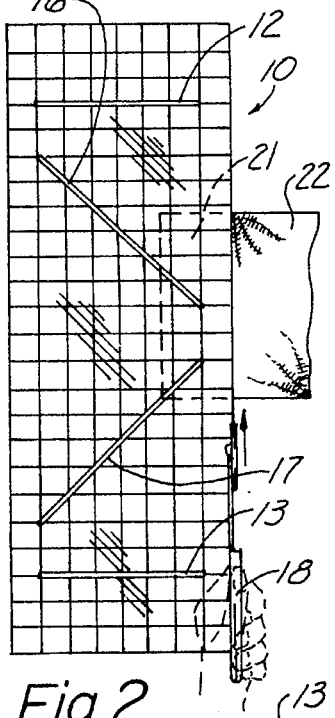
FIG. 2 shows a process of cutting triangles from a stack or multiple sheets of cloth by first cutting off a rectangular shaped strip off of one edge of the layers of cloth.

By using a slot such as slots (12, 13, 16, and 17), the cutter blade (19) will be positively guided along its path and be prevented from moving from one side to another as would be possible if only one edge is to be used, for example as in the FIG. 2 step. This double sided guide has the advantage of preventing mistakes in the cutting of the cloth and furthermore has a safety advantage in that it reduces the likelihood that the cutter blade (19) will be diverted in any way where it might become a safety hazard to the other hand of the user.

Figure 7:
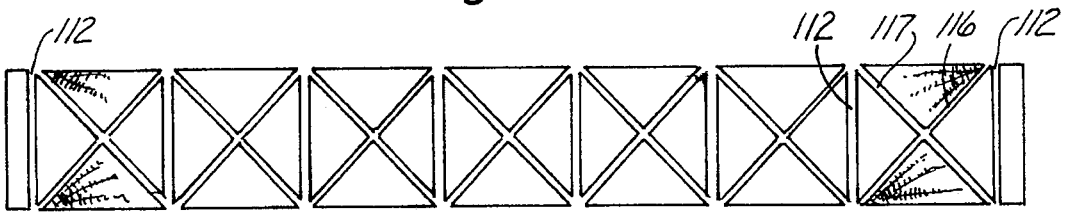
Figure 8:
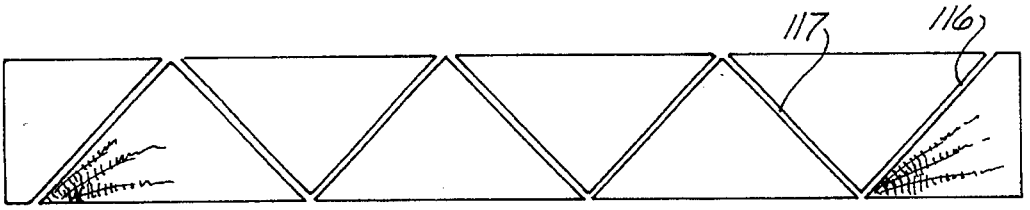
Figure 9:
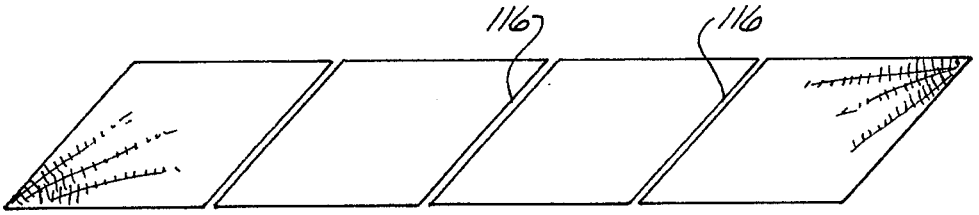
Figure 10:
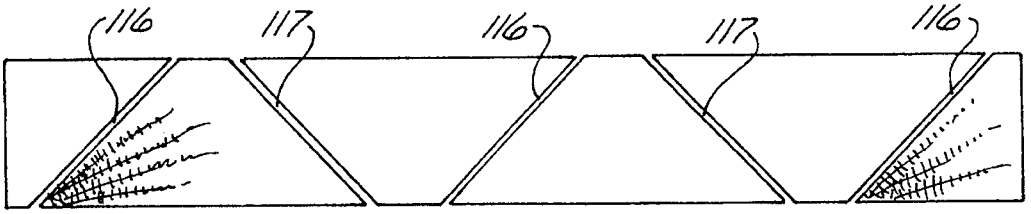

Referring now to FIG. 7, is noted that the cuts (112) are made by passing the cutter through slots (12) in guide (10), the cuts (116) are made by passing the cutter through slots (16) in the guide (10) and the cuts (117) being made by passing the cutter (18) through slot (17) in the cutting guide (12). Similarly, in FIG. 8, 9, and 10 cuts (116) are made by using slot (16) and cuts (117) are made by using slot (17) as a guide.

Figure 11:
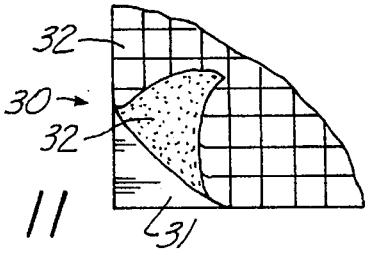
FIG. 11 is a perspective view of a portion of a static sticker with a portion of the paper backing having a grid painted thereon peeled back to expose the plastic static sticker thereunder.
Figure 12:
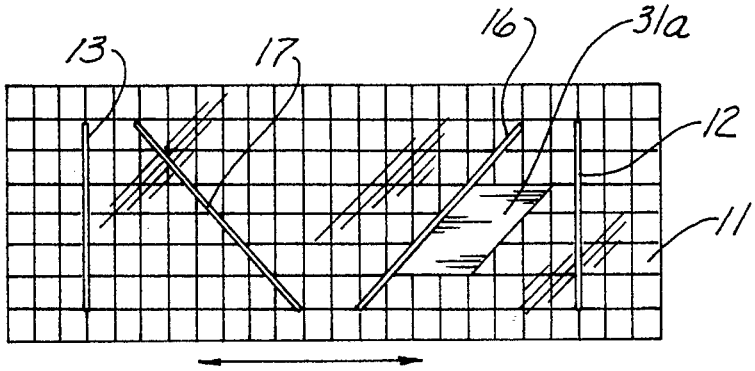
FIG. 12 and 13 show how a static sticker can be attached to a cutting guide so that the static sticker can be used as a pattern to achieve proper placement of the cutting guide slot desired.
Figure 13:
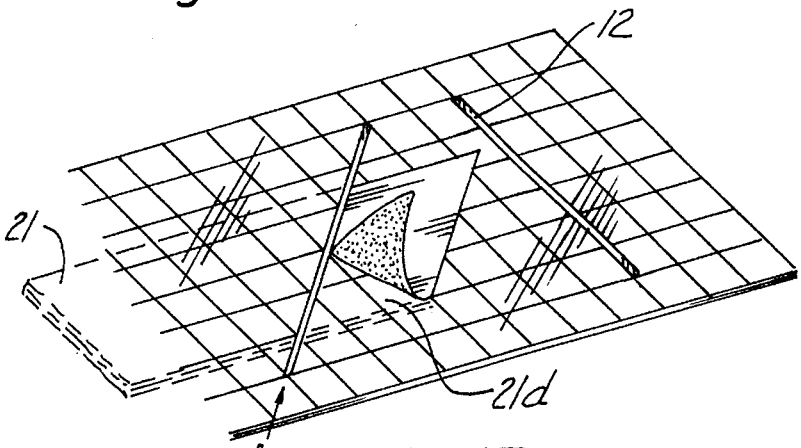

Referring now to FIG. 11–13, it is noted that a static sticker (30) is formed of a 8 millimeter static cling polyvinyl chloride material (31) with a paper backing (32) having a grid printed thereon for references purposes. The static sticker (30) is transparent so it can be seen through, but it is tinted so that it can easily be seen. The transparent static sticker (30) is tinted by printing a layer of color on the top thereof, although it could be tinted by merely adding a dye to the plastic resin prior to forming it into a sheet. FIG. 11 shows one corner of the paper (32) being peeled up to show the static sticker (31) thereunder. The static sticker (31) is basically formed of a material that will adhere to sheet (11) so that when the paper backing (32) is removed and that exposed surface of the material (31) is placed on top of sheet (11) of guide or ruler (10), that the static sticker will stay firmly in place by static electricity or the like. Other patterns formed with materials such as having a glue like that on POST IT NOTES® or the like could be used instead.

To utilize the static sticker, a portion thereof (31*a*) has been cut into the shape desired for forming cloth pieces for quilts of an identical shape. Consequently, when placed in the position shown in FIG. 12 on the sheet (10), with one edge adjacent slot (16), the user can merely look through the sheet (11) and align the right edge of the static sticker with a diagonal edge of the stack of cloth (21). The user can then cut through the slot (16) to form a stack of cloth shapes (21*d*) therebelow which are of the same shape as the static sticker (31*a*). Once that cut has been made, the right edge of the static sticker and the sheet and the guide (10) would be moved to the left so as to align the right edge of the static sticker to the new edge of the stack of cloth (21), so that another cut can be made to form another stack (21*d*) of shapes identical to the shape of the static sticker (31A). This process is repeated until the entire length of cloth (21) is exhausted or the desired number of sheets or pieces of cloth in the shape of static sticker (31) have been formed.

Figure 14:
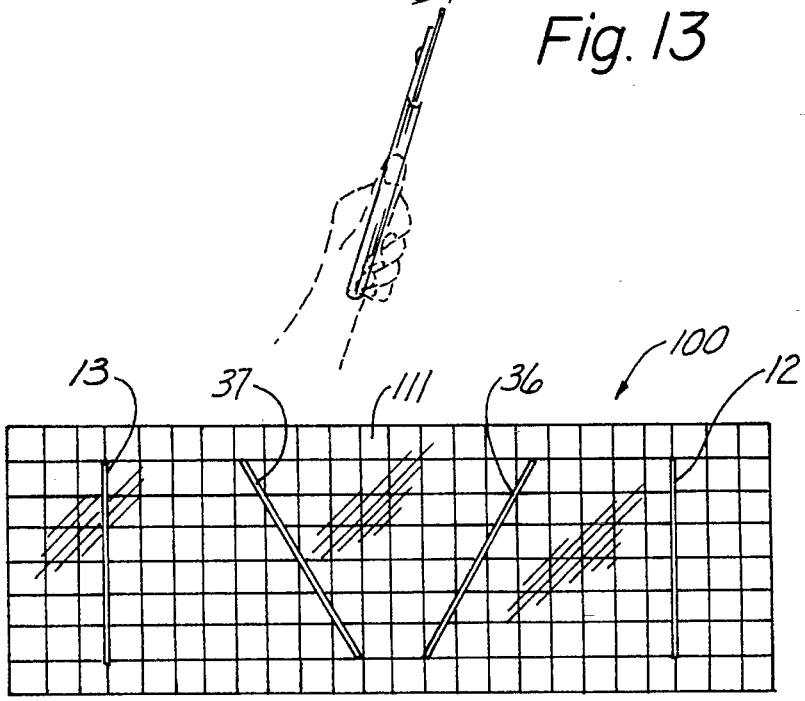
FIG. 14 shows a cutting guide similar to FIG. 1–5, except that the angled slots are disposed at 60°, instead of 45°, with respect to the vertical cutting guide slots.

Referring now to FIG. 14 it is noted that the ruler or guide (100) is essentially the same as the ruler or guide (10) shown in FIG. 1–13, except that slot (36) is formed at a 60° angle with respect to the lower horizontal line of sheet (111) and the guide slot (37) is formed at an opposite 60° angle with respect to the lower horizontal edge of sheet (111).

Obviously many modifications and variations of the present invention are possible in light of the above teachings. For example, the slots or guides can be placed in the sheets (11) and (111) at other angles or other orientations. It is even possible to use a curved line under certain circumstances, instead of linear slots in the members (11) and (111). It is therefore to be understood that, within the scope of the appended claims, the invention may be practice otherwise then specifically described.

We claim:

1. A method of using an apparatus of a type including a sheet of transparent material; a first linear slot disposed through said sheet at a first location on said sheet, whereby a cutter can extend therethrough to cut several layers of cloth; and a second linear slot disposed through said sheet at a second position thereof, said second slot being oriented at an angle of less than 90° with respect to said first linear slot, whereby a cutter can extend therethrough to cut several layers of cloth, said method comprising:

attaching a static sticker with parallel edges to said sheet so that one of said edges thereof is aligned with one of the slots;

placing several layers of cloth on a flat support surface;

placing said sheet over said layers of cloth while referencing the position of said static sticker on said sheet;

using a cutter disposed through said first linear slot to cut through said layers of cloth;

removing said cutter from said first slot;

moving said sheet with respect to said layers of cloth before said cutter is used in said second slot; and placing said cutter in said second slot to cut said layers of cloth.

2. The method of claim 1 including the step of aligning the other parallel edge of said static sticker with the edges of the last cut through said layers of cloth and then using said cutter to cut through said layers of cloth into a shape like the shape of said static sticker.

3. A method for cutting cloth into shapes for use in quilts using an apparatus comprising a sheet of transparent material; a first linear slot disposed through said sheet at a first location on said sheet, whereby a cutter can extend therethrough to cut several layers of cloth; a second linear slot disposed through said sheet at a second position thereof, said second slot being oriented at an angle of less than 90° with respect to said first linear slot, whereby a cutter can extend therethrough to cut several layers of cloth;

a third linear slot disposed in said sheet, said third linear slot being both non-parallel and non-perpendicular to both of said first and second linear slots; and wherein more than half the length of said second linear slot is disposed directly between a path or trajectory extending from a first end of the first slot to a first end of the third slot and a path or trajectory extending from a second end of the first slot to a second end of the third slot whereby said sheet can be shifted along the same general linear path to move from using one of the slots to any other one of the slots; said method comprising:

placing said sheet over a piece of cloth to be cut into pieces;

using a cutter to cut said cloth through said first slot;

shifting said sheet in one direction along said same general linear path;

using said cutter to cut said cloth through said third slot;

shifting said sheet in an opposite direction to said one direction along said same general linear path;

using said cutter to cut said cloth through said second slot;

shifting said sheet in said one direction again along said same general linear path; and using said cutter to cut said cloth again through said third slot.

4. The method of claim 3 including the steps of:

shifting said sheet again in said direction opposite to said one direction but in said same general path; and using said cutter to cut said cloth again through said second slot.

5. Apparatus for cutting cloth into shapes for use in quilts comprising:

a sheet of transparent material;

a first linear slot disposed through said sheet at a first location on said sheet, whereby a cutter can extend therethrough to cut several layers of cloth;

a second linear slot disposed through said sheet at a second position thereof, said second slot being oriented at an angle of less than 90° with respect to said first linear slot, whereby a cutter can extend therethrough to cut several layers of cloth;

a third linear slot disposed in said sheet, said third linear slot being both non-parallel and non-perpendicular to both of said first and second linear slots;

wherein more than half of the length of said second linear slot is disposed directly between a path or trajectory extending from a first end of the first slot to a first end of the third slot and a path or trajectory extending from a second end of the first slot to a second end of the third slot whereby said sheet can be shifted along the same general linear path to move from using one of the slots to any other one of the slots; and a removable flexible plastic static sticker disposed on said sheet for references purposes, said static sticker having at least one straight edge aligned with one of said slots, whereby a user can move the sheet with the static sticker thereon over the layers of cloth and then cut the cloth into the shape of the static sticker.

6. The apparatus of claim 1 including several layers of cloth disposed below said sheet and a cutter disposed in one of said slots.

7. The apparatus of claim 1 including a fourth linear slot in said sheet, said fourth linear slot being parallel to said first linear slot.

8. The apparatus of claim 7 wherein said third linear slot is disposed between said second and fourth linear slots.

9. The apparatus of claim 1 wherein an opaque grid pattern is disposed on said sheet for reference purposes.

10. The apparatus of claim 1 wherein an opposite edge from said straight edge of said static sticker is parallel to said straight edge thereof, whereby the opposite edge of the static sticker can be aligned with the previous cut through said layers of cloth just prior to cutting said layers of cloth through said one of the slots.

11. The apparatus of claim 5 wherein said sheet is constructed of polycarbonate plastic.

12. The apparatus of claim 5 wherein:

a longitudinal axis extends along and through said first linear slot;

a longitudinal axis extends along and through said second linear slot;

a longitudinal axis extends along and through said third linear slot;

wherein a first one of said longitudinal axes intersects a second one of said longitudinal axes at a first acute angle and the third one of said longitudinal axes intersects said first one of said longitudinal axes at an acute angle which is the same as said first acute angle; and wherein said second and third longitudinal axes are non-parallel and the second and third longitudinal axes intersect each other.

13. Apparatus for cutting cloth into shapes for use for quilt-making comprising:

a first sheet of transparent material adapted to be used as a ruler and for assistance in cutting cloth along straight lines;

a second sheet of flexible plastic material formed in the shape of cloth shapes desired to be formed; and means for releasably attaching said second sheet of material to said first sheet of transparent material so that different second sheets of material in different shapes can be interchanged with said second sheet of material wherein said means for releasably attaching includes static means for causing said second sheet to adhere to said first sheet of transparent material.

14. The apparatus of claim 13 wherein said first sheet of transparent material is semi-rigid.

15. The apparatus of claim 13 wherein said second sheet of material is transparent.

16. The apparatus of claim 15 wherein said second sheet of material is tinted.

17. Apparatus for cutting cloth into shapes for use in quilts comprising:

a sheet of transparent material;

a first linear slot oriented through said sheet at a first location on said sheet, whereby a cutter can extend therethrough to cut several layers of cloth;

a second linear slot disposed through said sheet at a second position thereof, said second slot being oriented at an angle of less than 90° with respect to said first linear slot, whereby a cutter can extend therethrough to cut several layers of cloth; and a removable flexible plastic static sticker disposed on said sheet for references purposes, said static sticker having at least one straight edge aligned with one of said slots, whereby a user can move the sheet with the static sticker thereon over the layers of cloth and then cut the cloth into the shape of the static sticker.

18. The apparatus of claim 17 wherein an opposite edge from said straight edge of said static sticker is parallel to said straight edge thereof, whereby the opposite edge of the static sticker can be aligned with the previous cut through said layers of cloth just prior to cutting said layers of cloth through said one of the slots.

19. Apparatus for cutting cloth into shapes for use in quilts consisting of:

a sheet of transparent material having an opaque pattern thereon;

a first linear slot disposed through said sheet at a first location on said sheet, whereby a cutter can extend therethrough to cut several layers of cloth;

a second linear slot disposed through said sheet at a second position thereof, said second slot being oriented at an angle of less than 90° with respect to said first linear slot, whereby a cutter can extend therethrough to cut several layers of cloth;

a third linear slot disposed in said sheet, said third linear slot being both non-parallel and non-perpendicular to both of said first and second linear slots;

wherein more than half of the length of said second linear slot is disposed directly between a path or trajectory extending from a first end of the first slot to a first end of the third slot and a path or trajectory extending from a second end of the first slot to a second end of the third slot whereby said sheet can be shifted along the same general linear path to move from using one of the slots to any other one of the slots;

a longitudinal axis extending along and through said first linear slot;

a longitudinal axis extending along and through said second linear slot;

a longitudinal axis extending along and through said third linear slot;

wherein a first one of said longitudinal axes intersects a second one of said longitudinal axes at a first acute angle and the third one of said longitudinal axes intersects said first one of said longitudinal axes at an acute angle which is the same as said first acute angle; and wherein said second and third longitudinal axes are non-parallel and the second and third longitudinal axes intersect each other.

20. Apparatus for cutting cloth into shapes for use in quilts consisting of:

a sheet of transparent material having an opaque pattern thereon;

a first linear slot disposed through said sheet at a first location on said sheet, whereby a cutter can extend therethrough to cut several layers of cloth;

a second linear slot disposed through said sheet at a second position thereof, said second slot being oriented at an angle of less than 90° with respect to said first linear slot, whereby a cutter can extend therethrough to cut several layers of cloth, said second linear slot having a first and a second side, said first and second sides being parallel with respect to each other;

a third linear slot disposed in said sheet, said third linear slot being both non-parallel and non-perpendicular to both of said first and second linear slots; and wherein more than half of the length of said second linear slot is disposed directly between a path or trajectory extending from a first end of the first slot to a first end of the third slot and a path or trajectory extending from a second end of the first slot to a second end of the third slot and said more than half of the length of said second linear slot is substantially the same length as said third linear slot whereby said sheet can be shifted along the same general linear path to move from using one of the slots to any other one of the slots.

21. Apparatus for cutting cloth into shapes for use in quilts consisting of:

a sheet of transparent material having an opaque pattern disposed thereon for reference purposes;

a first linear slot disposed through said sheet at a first location on said sheet, whereby a cutter can extend therethrough to cut several layers of cloth;

a second linear slot disposed through said sheet at a second position thereof, said second slot being oriented at an angle of less than 90° with respect to said first linear slot, whereby a cutter can extend therethrough to cut several layers of cloth;

a third linear slot disposed in said sheet, said third linear slot being both non-parallel and non-perpendicular to both of said first and second linear slots;

wherein more than half the length of said second linear slot is disposed directly between a path or trajectory extending from a first end of the first slot to a first end of the third slot and a path or trajectory extending from a second end of the first slot to a second end of the third slot whereby said sheet can be shifted along the same general linear path to move from using one of the slots to any other one of the slots;

a longitudinal axis extending along and through said first linear slot;

a longitudinal axis extending along and through said second linear slot;

a longitudinal axis extending along and through said third linear slot;

wherein a first one of said longitudinal axes intersects a second one of said longitudinal axes at a first acute angle and the third one of said longitudinal axes intersects said first one of said longitudinal axes at an acute angle which is the same as said first acute angle;

wherein said second and third longitudinal axes are non-parallel and the second and third longitudinal axes intersect each other; and a fourth linear slot disposed through said sheet, said fourth linear slot being parallel to said first linear slot.

* * * * *